US005231713A

United States Patent [19]

McDonnell

[11] Patent Number: 5,231,713

[45] Date of Patent: Aug. 3, 1993

[54] DETACHABLE BED LEGS

[76] Inventor: Timothy J. McDonnell, 736 Federal St., Davenport, Iowa 52803

[21] Appl. No.: 990,316

[22] Filed: Dec. 14, 1992

[51] Int. Cl.[5] ..... A47C 19/02

[52] U.S. Cl. ..... 5/310; 5/200.1; 248/188; 248/188.8

[58] Field of Search ..... 5/200.1, 310; 108/156; 248/188, 188.8; 312/351.3

[56] References Cited

U.S. PATENT DOCUMENTS 2,305,980 12/1942 Mollenhour et al. .
2,466,494 12/1947 Slagle .
2,484,969 10/1949 Stacy ..... 248/188.8 X
2,599,723 6/1952 Row ..... 5/310
2,617,125 8/1949 Leefeldt .
2,638,607 5/1949 Evans .
2,768,392 10/1956 Shapiro ..... 5/310
2,779,952 2/1957 Sten .
3,497,881 3/1970 Price ..... 5/310
3,828,376 8/1974 Miller ..... 5/310 X
4,827,543 5/1989 Castiglioni et al. ..... 5/310 X

*Primary Examiner*—Michael F. Trettel
*Attorney, Agent, or Firm*—Henderson & Sturm

[57] ABSTRACT

A leg apparatus for convenient attachment to a conventional angle-brace bed frame such that the height of the bed may be increased thereby increasing the area for storage beneath and also for producing a more aesthetically pleasing appearance. The invention embodies one type of leg for attachment to the perimeter frame and a second type of leg for attachment to the frame cross-member.

3 Claims, 2 Drawing Sheets

DETACHABLE BED LEGS

TECHNICAL FIELD

This invention relates generally to support legs for attachment to a conventional bed frame, and more particularly to legs which may be easily and conveniently attached so as to raise a bed in order to facilitate storage beneath the bed or for aesthetic purposes.

BACKGROUND ART

Bed frames are typically supported by legs which are welded to the frame or riveted to the frame. In either case, the attachment is intended to be permanent and there is no means to raise or lower the frame in relationship to the floor. Numerous references show a variety of means of attaching legs of different types to bed springs or to a bed frame. Evans, U.S. Pat. No. 2,638,607, teaches an adjustable leg utilizing a plurality of bolts and a straplike member for attachment to a bed frame. Leefeldt, U.S. Pat. No. 2,617,125, teaches a J-shaped clamp bolt which passes diagonally through a leg and is secured over the horizontal portion of a bed spring. Slagle, U.S. Pat. No. 2,466,494 teaches the use of clamping members which are secured over the edges of a bed spring frame.

DISCLOSURE OF THE INVENTION

The present invention discloses a leg apparatus which may be easily attached to a conventional angle-brace bed frame such that the frame height above the floor may be increased so as to facilitate storage of items beneath the bed or for purely aesthetic purposes. Previous inventions in this area were often directed to bed springs rather than conventional bed frames. These references, even if capable of adaptation to a bed frame, are usually adapted to an L-shaped frame member in which the vertical section points down rather than up, and are therefore unacceptable for use in the conventional metal bed frame toward which the present invention is directed.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
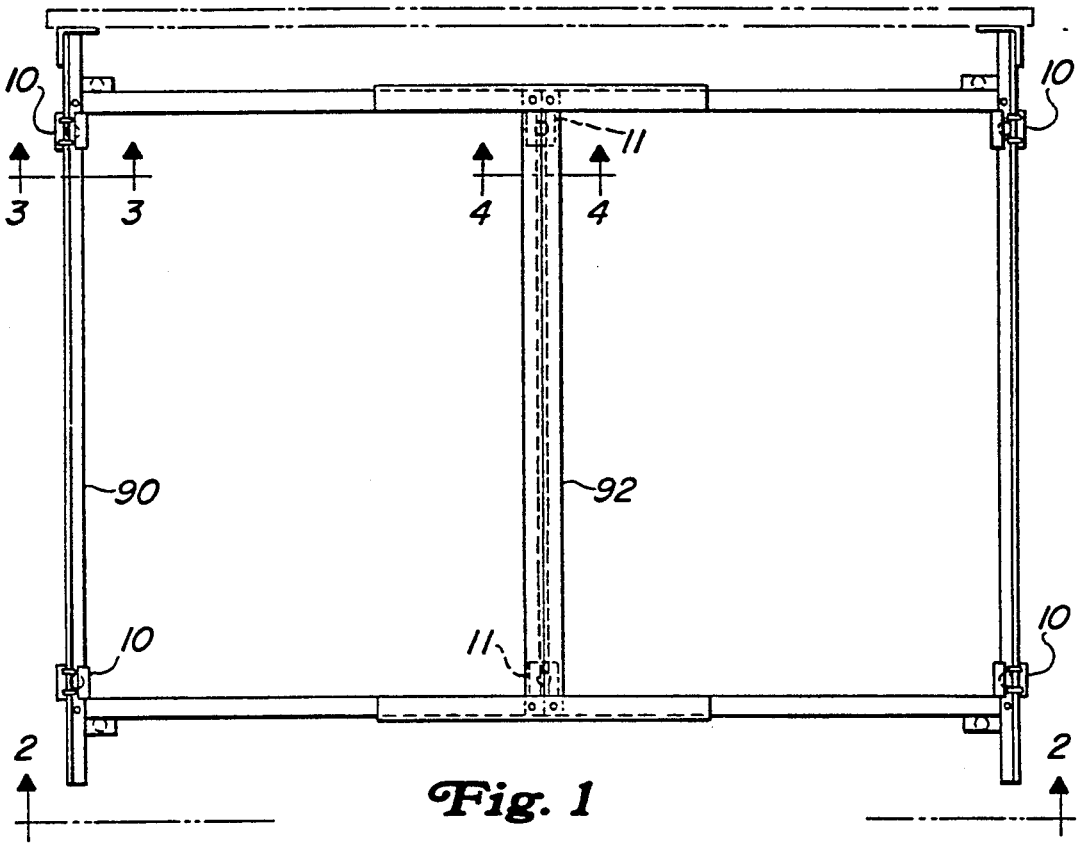
FIG. 1 is a plan view of a conventional bed frame employing the present invention.
Figure 2:
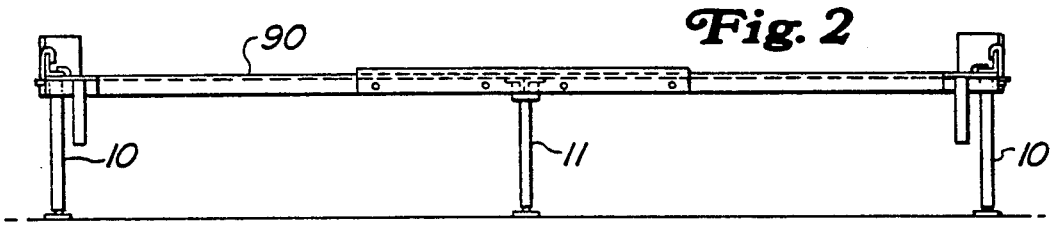
FIG. 2 is a elevational view from along line 2—2 of FIG. 1.

Referring now to the drawings, wherein like reference numerals designate identical or corresponding parts throughout the several views, FIG. 1 is a top plan view of a conventional bed frame with the present invention 10 and 11 supporting the frame above the floor.

Figure 3:
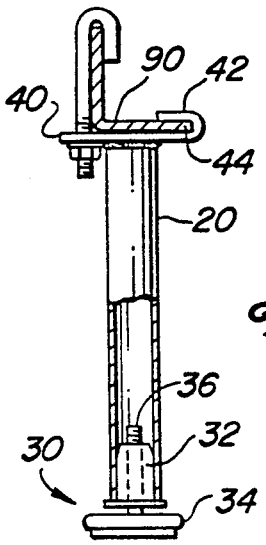
FIG. 3 is a partial section view along line 3—3 of FIG. 1.
Figure 4:
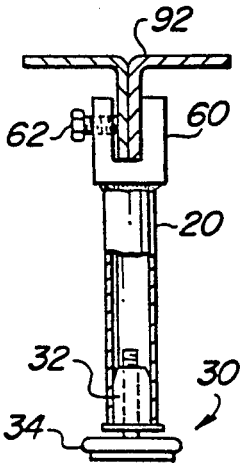
FIG. 4 is a partial section view along line 4—4 of FIG. 1.
Figure 5:
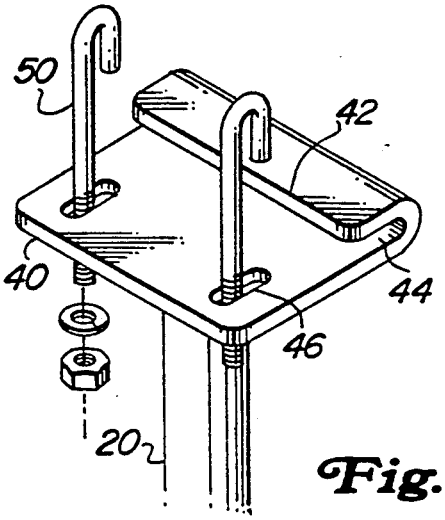
FIG. 5 is a perspective view of one embodiment of the present invention for supporting the perimeter frame.
Figure 7:
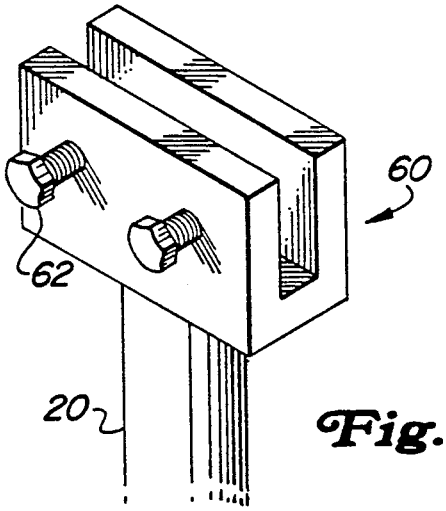
FIG. 7 is a perspective view of the present invention for supporting a cross-member of the bed frame.

FIG. 5 most clearly shows a preferred embodiment of the present invention for supporting the perimeter bed frame, while FIG. 7 most clearly shows a preferred embodiment of the present invention for supporting the cross-member of the bed frame. Both of these figures show a longitudinal, vertical member 20, preferably fabricated from metal tubing. FIG. 3 and FIG. 4 best illustrate a floor plate or foot 30 which is secured to the lower end of the tube 20 and which prevents damage to the floor upon which the bed frame rests and also allows the frame to be more easily moved. In a preferred embodiment, the foot 30 is a commercially available item which may be secured to the support tube 20 by insertion of a plastic extension of the foot 32 into the support tube 20, as may be seen in partial section in FIG. 3. The lower, floor glide section 34 is secured to the plastic extension section 32 by means of a threaded bolt 36. The extension of the lower, floor glide section 34 of the foot 30 from the support tube 20 may then be adjusted by screwing the floor guide section 34 into or out of the extension 32.

Figure 6:
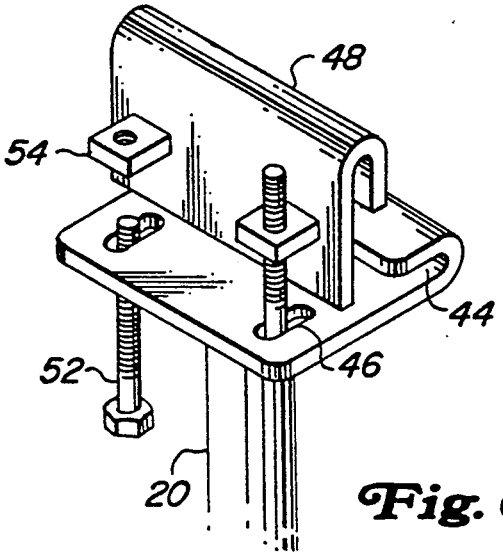
FIG. 6 is a perspective view of a second embodiment of the present invention for supporting the perimeter frame.

FIG. 5 illustrates a top plate 40 which is secured, preferably by welding, to the upper end of support tube 20. This plate 40 has one edge 42 which has been bent back over itself 180 degrees, forming a gap or channel 44 of approximately one eighth inch to accommodate the lower flange of the typical L-shaped angle bracket of conventional bed frames. This is most clearly seen in FIG. 3 where the lower flange of bed frame 90 is shown fitted into gap 44 of top plate 40. Top plate 40 also has one or more elongate holes 46 drilled through it, preferably two such holes. Clearly seen in FIG. 5, these holes are adjacent the edge of the top plate which is furthest from the channel 44, and are positioned such that the elongate axis is perpendicular to the edge. Through each of these holes 46 is fitted a J-bolt 50 (FIG. 5) or a common bolt 52 (FIG. 6) depending on the particular embodiment of the invention. In the preferred embodiment, the J-bolts 50 will be fitted through the elongate holes 46 and may then be positioned therein so as to engage the vertical flange of the typical L-shaped angle bracket of the bed frame (FIG. 3) and then secured by tightening the nut.

In a second embodiment of the invention, the J-bolts may be replaced by a J-shaped plate 48 which is fabricated in much the same manner as is the top plate 40 in that one edge of the plate is bent back over itself to form a channel of approximately one eighth inch width. Secured to the J-shaped plate 48 are one or more threaded flanges 54 capable of receiving threaded bolts 52 which have first passed through the elongate holes 46. As previously described for the J-bolt embodiment, the J-shaped plate 48 may be positioned so as to engage the vertical flange of the typical L-shaped angle bracket of the bed frame (FIG. 3) and then secured by tightening the bolt 52.

The invention further embodies a second type of support leg which is capable of engaging the cross-member 92 of a typical bed frame, ordinarily one of larger size, as is most clearly depicted in FIG. 1, 4, and 7. The construction of this support leg is identical to that previously described except for the upper channel 60 which is secured to the upper end of vertical member 20, preferably by welding. The channel 60 has sufficient width, approximately one fourth inch, and sufficient depth, approximately one inch, to accommodate the vertical flange of the cross-member. The channel also has one or more set bolts 62 threaded into one side of the channel which, when tightened, will secure the leg to the cross-member.

As best seen in FIG. 1, it is envisioned that this invention will be attached at each of the four corners of the perimeter frame, and also at opposite ends of the frame cross-member. This will provide sufficient support for the bed while raising it further above the floor than is possible with standard legs. This increased height then provides for increased storage area beneath the bed and is also more aesthetically pleasing.

Those skilled in the art will recognize that many modifications and variations of the present invention are possible in light of the above teachings. It is therefore to be understood that, within the scope of the appended claims, the invention may be practiced otherwise than as specifically described.

I claim:

1. A detachable leg apparatus for raising the height of a bed frame, comprising: a first leg assembly having (a) a first elongate member with a first end and a second end;

(b) a base plate secured to the first end of the first elongate member;

(c) an end plate secured to the second end of the first elongate member and perpendicular thereto, the end plate having a slot extending therethrough adjacent a first edge of the end plate, and having a second edge opposite the first edge bent back partially over itself wherein a narrow channel is formed; and (d) means for securing the second end plate to a bed frame;

and a second leg assembly having (e) a second elongate member with a first end and a second end;

(f) a base plate secured to the first end of the second elongate member;

(g) a U-shaped channel assembly secured to the second end of the second elongate member and having a clamping screw extending through one side of the channel when tightened whereby a bed frame may be secured to said channel assembly.

2. The detachable leg apparatus as recited in claim 1, wherein the means for securing the second end plate comprises a J-bolt.

3. The detachable leg apparatus as recited in claim 1, wherein the means for securing the second end plate comprises a J-shaped plate having a threaded flange extending laterally therefrom and a threaded bolt.

* * * * *